US006367631B1

(12) United States Patent
Steigerwald

(10) Patent No.: US 6,367,631 B1
(45) Date of Patent: Apr. 9, 2002

(54) LOCKING SYSTEM FOR STACKING BOXES AS WELL AS A STACKING BOX SYSTEM

(75) Inventor: Manfred Steigerwald, Aschaffenburg (DE)

(73) Assignee: I.V.E. AG Gesellschaft fuer Innovative Verpackungsentwicklungen, Gallen (CH)

( * ) Notice: Subject to any disclaimer, the term of this patent is extended or adjusted under 35 U.S.C. 154(b) by 0 days.

(21) Appl. No.: 09/539,678

(22) Filed: Mar. 30, 2000

(30) Foreign Application Priority Data

Mar. 31, 1999 (DE) ..... 199 14 635

(51) Int. Cl.[7] ..... B65D 21/00

(52) U.S. Cl. ..... 206/509; 206/511; 206/510; 206/459.5; 220/23.4

(58) Field of Search ..... 206/509, 511, 206/510; 220/23.4; 211/126.12

(56) References Cited

U.S. PATENT DOCUMENTS 3,713,579 A * 1/1973 Chaffers ..... 206/509
4,266,714 A * 5/1981 Crane ..... 206/509
4,807,756 A * 2/1989 Young et al. ..... 206/509
5,016,811 A * 5/1991 Kapare ..... 206/509
5,039,002 A * 8/1991 Spamer ..... 206/459.5
5,325,966 A * 7/1994 Chang ..... 206/372
5,421,455 A * 6/1995 Clantanoff et al. ..... 206/701
5,469,961 A * 11/1995 Chang ..... 206/312

* cited by examiner

*Primary Examiner*—Ted Kavanaugh
*Assistant Examiner*—Troy Arnold
(74) *Attorney, Agent, or Firm*—Milde, Hoffberg & Macklin, LLP

(57) ABSTRACT

The invention describes a locking system for stacking boxes that is characterized by individual plate-shaped elements, where two such plate-shaped elements each are assigned and can be attached to two opposite sides of a stacking box. Each element exhibits locking components at its top and bottom side, that can be locked in an engaging manner to locking components of elements that are assigned to a stacking box stacked above or below.

19 Claims, 5 Drawing Sheets

LOCKING SYSTEM FOR STACKING BOXES AS WELL AS A STACKING BOX SYSTEM

BACKGROUND OF THE INVENTION

The present invention relates to a locking system for stacking boxes as well as to a stacking box system with several stacking boxes stacked on top of one another, where each stacking box exhibits one locking system.

It is a known practice to sort components, in particular individual components, that are to be assembled into one unit at an assembly line, into various stacking boxes that may also exhibit several subdivisions, and to stack these boxes onto a palette. These palettes can then be prepared on an assembly fixture such that the individual components are well visible for retrieval from the stacking boxes.

Of course, such stacking boxes are also stacked on Euro palettes, especially for transportation of other goods.

Stacking boxes arranged on such Euro palettes must be secured for transportation to prevent slipping. For this purpose, it is common to secure the stacking boxes to the palette using strap bands, or to wrap the stacking boxes together with the palette using so-called shrink film. Such measures are time and material consuming packaging steps with the additional consequence that the palettes must be freed of the packaging material at the assembly area; in addition, such packaging material must be disposed of. In particular as a consequence of such strapping bands, the problem arises that the stacking boxes can be deformed and damaged on the edges where the strapping bands are located. This is an additional reason why it is common to cover the stacking boxes stacked on the palette on their upper side with a covering, which on the one hand covers and closes the stacking boxes that are located in the top position, and on the other hand ensures a protection for the edges. Additional palettes may also be stacked on top of one another using these covers.

SUMMARY OF THE INVENTION

Based on the state-of-the-art described above and the related problems, it is the objective of the present invention to create a system, in particular a locking system, where the disadvantages mentioned in the state-of-the-art above do not occur and where particularly costly packaging material, as described above, will not be necessary.

This objective is achieved with a locking system for stacking boxes, where individual plate-shaped elements are provided, where two each of such plate-shaped elements can be assigned to two opposite sides of a stacking box and can be attached to this stacking box, where each element exhibits locking components on its top and bottom side, where said locking components can be locked by engaging in locking components of elements that are assigned to stacking boxes that are stacked above and/or below.

The invention also relates to a stacking box system with several stacking boxes stacked on top of one another, where each stacking box exhibits a locking system as described above such that the individual stacking boxes are locked to one another.

Thus, the locking system for stacking boxes subject to the invention consists of individual plate-shaped elements that are preferably located on the face side of stacking boxes with rectangular base area, that is, located on the narrow side, that is, they are bolted to or by some other means attached to the stacking box in this area. These individual plate-shaped elements exhibit on both their top side and their bottom side, that is, in the area of the stacking box base and in the area of the upper edge of the stacking box, locking elements that are locked together with stacking boxes located above or below, which exhibit such plate-shaped elements with locking components as well. Thus, the individual stacking boxes can be stacked on top of one another and at the same time they are secured to one another with the locking elements that engage in one another such that they cannot separate or slip. At the same time, it is, of course, possible to transport such stacking boxes in the form of a stack without the stack falling apart even if the stack is not held in the vicinity of the bottom stacking box. With such a locking system, no additional packaging materials are required for the transportation of such stacking boxes, in particular such materials that need to be disposed of after unpacking.

Preferably, such a locking system exhibits locking components in the form of hook elements that engage in corresponding counter parts of the respective stacking box stacked above or below, where for this purpose eyes or hooks may be provided, or as is preferred, openings are provided where such hook elements can engage.

Furthermore, in an additional embodiment, the individual hook elements can be assigned in pairs to the top or bottom side of the element.

To enable an easy and uncomplicated separation of the individual hook elements from their engagement with the locking components of the other element, particularly without having to use special tools, an actuation device should be integrated in the plate-shaped element with which the hook elements can be separated from the engagement with the locking components of the other element upon actuation. A connecting component that connects the respective hook elements of one pair to each other has proven to be a particularly simple, constructive measure for building such an actuation device, where the two hook elements are released from their engagement simultaneously by applying a pressure force or a pull force. After releasing the connecting component, the hook elements can return to their starting position, that is, to the position where they can be placed in the connecting component of the other plate-shaped element in a locking manner.

To enable a sufficient movement of the hook elements, and that with a high flexibility, the hook elements may be provided with a flexible arm that with its one end is connected to the base body of the plate-shaped element while a locking component is located at the other, free end.

A hook lip should be provided at the hook elements, possibly with a slanted surface that can guide the hook lip into its locking position. In addition, the hook lips of a hook element pair should be pointing apart from each other to the outside of the element, especially in connection with the connecting component, such that the two hook lips can be separated easily when actuating the connecting component.

The plate shaped elements must be build robustly, since it is possible that great forces may affect these elements, especially when big stacks of individual stacking boxes are formed; however, such plate-shaped elements should also be light-weight. For this reason, an H-shape of such a plate-shaped element with a crossbar and four free ends is preferred. With such an H-shaped configuration of the element, the respective locking components can be provided at the four free ends. Especially in connection with the hook lips as have been described above, two of the four free ends of the H-shaped element can exhibit locking components in the form of openings for the hook elements to engage. Hook elements that are positioned at the aforementioned flexible arm can then engage at the cross bar such that the respective flexible arms are protected between the two legs of the H-shape.

In addition, in connection with an H-shaped element, the connecting component, which serves the purpose of an actuating device for releasing the hook elements from their engagement, should, for one, be located in the area of the free ends of the flexible arms and, for another, the connecting component should run about parallel to the crossbar. To support a locking engagement, if a connecting bar is provided as an actuating device, this cross bar can then be curved in the shape of a bow, such that, when it is not actuated, it exerts pressure on the hook elements such that they are pushed apart from each other.

The plate-shaped elements as described can be manufactured as synthetic injection mold components.

To integrate such plate-shaped elements in stacking boxes, they can be arranged in a flat manner on the outside of two opposite sidewalls of such stacking boxes, or stacking boxes can be used that exhibit a cavity running vertical in the side wall, where such a plate-shaped element can be inserted such that it does not protrude beyond the outside area of such a stacking box.

As already described above, stacking box systems can be erected in connection with such locking devices, where several stacking boxes are stacked on top of one another. The respective bottom stacking box can then be locked to a palette using its locking components with which it is generally locked to a respective other stacking box. For this purpose, corresponding locking components for the other locking components to hook into must be built into the palette. Furthermore, the respective top stacking box of a stack can be covered with a covering, where this covering is locked into at least one part of the locking components of the top stacking box. Thus, no separate packaging and assemblies that would have to handled as individual components are required to attach a stack to the palette and to attach a covering to the stack(s); instead, a closed system is being built with the locking system as described, that is, the respective locking components and elements are, on one hand assigned to the stacking boxes, and on the other hand fitting palettes and coverings are provided.

It is obvious that several stacks made up of the same number of stacking boxes can be arranged on such a palette, for example on a so-called Euro palette, where the stacking boxes of a respective stack are locked to one another. The respective bottom stacking boxes are then locked to the palette, while the top stacking boxes of the individual stacks are covered with a common covering, for example a field of two times six stacking box stacks such that this common covering provides additional safeguarding of the individual stacks in the unit. Furthermore, such a covering can also constitute a stable support for placing an additional palette to build palette stacks.

To design the locking system to be even more flexible, the respective plate-shaped elements that are assigned to one side of a stacking box are preferably made of at least two element components, where the one element component exhibits the upper locking components and the other element component the bottom locking components. Based on the two-part design of the respective plate-shaped elements, the distance between the two element components can be changed to adjust the upper and lower locking components to stacking boxes of different heights. The two element components are then locked to one another at the adjusted height.

Lips and indentations that are arranged in a specified array or partition may be provided for locking the two element components to one another. The height of the plate-shaped element can then be adjusted according to the array specifications through different positions of the lips and indentations.

In a simple embodiment that also enables a fine adjustment of the height of the plate-shaped element, the lips and indentations are formed by respective toothed racks or toothings that are formed as toothed racks.

For the plate-shaped elements, comprised of at least two element components, to be able to absorb great forces in the direction of the locking components, that is, viewed at the height of the stacking boxes, without the locking components to disengage, it should be possible to engage the lips and indentations perpendicular to the plane of the plate-shaped elements or the element components. In this manner, it is possible to align the indentations and lips with narrow tolerances such that a tight fit is ensured.

In their relative positioning to one another, where the indentations and lips engage in one another, the two element components can finally be secured with the attachment of the plate-shaped element on the side of a stacking box.

It should be noted that the plate-shaped elements cannot only be built of two element components for adjusting the height, but also of three or more parts should this be required for constructive reasons. For example, the plate-shaped element may consist of a central carrier element that exhibits in an adjustable arrangement at its top and bottom sides one additional adjustable element each that carries the respective locking components.

For a full understanding of the present invention, reference should now be made to the following detailed description of the preferred embodiments of the invention as illustrated in the accompanying drawings.

DESCRIPTION OF THE PREFERRED EMBODIMENTS

The preferred embodiments of the present invention will now be described with reference to FIGS. 1–10 of the drawings. Identical elements in the various figures are designated with the same reference numbers.

Figure 1:
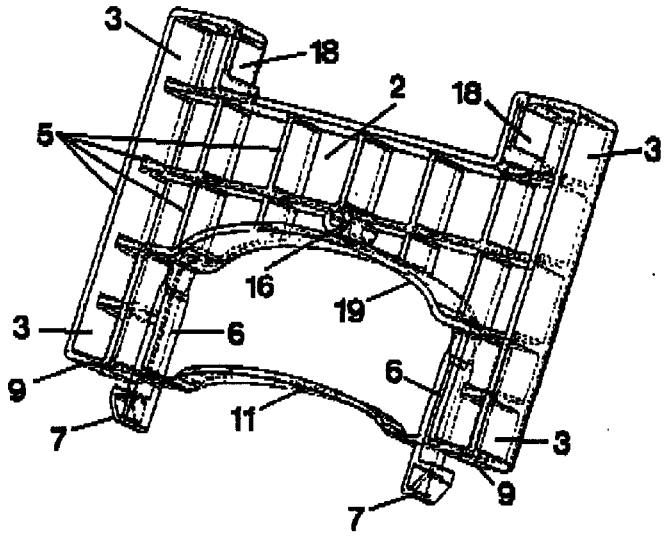
FIG. 1 shows a perspective view of a plate-shaped element of a first embodiments.
Figure 4:
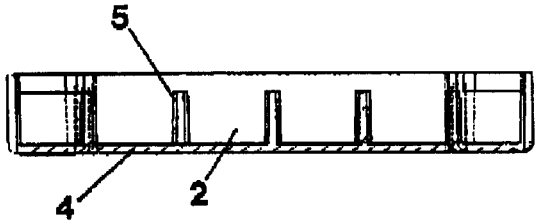
FIG. 4 shows a view in the direction of the sectional line IV—IV in FIG. 2.
Figure 2:
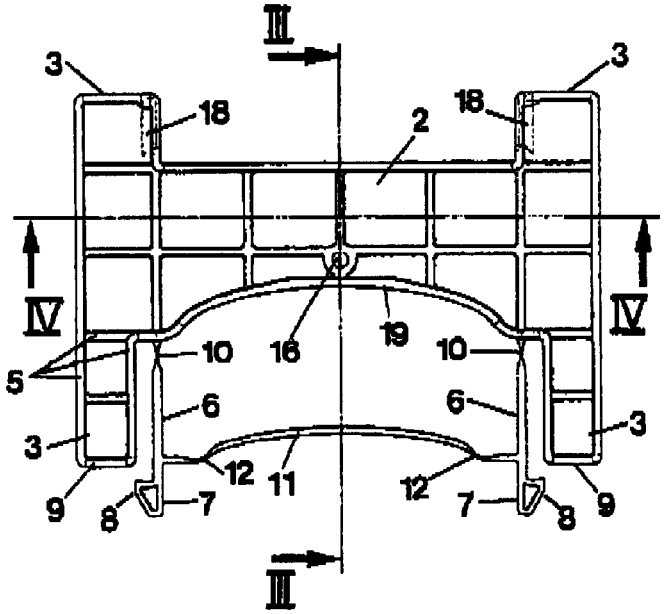
FIG. 2 shows an over head view of the plate-shaped element of FIG. 1.
Figure 3:
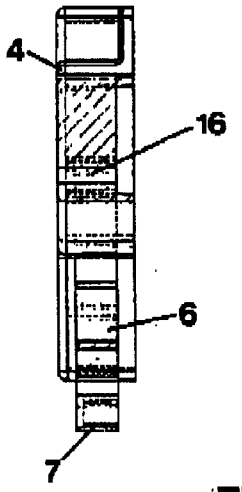
FIG. 3 shows a sectional view along sectional line III—III in FIG. 2.
Figure 5:
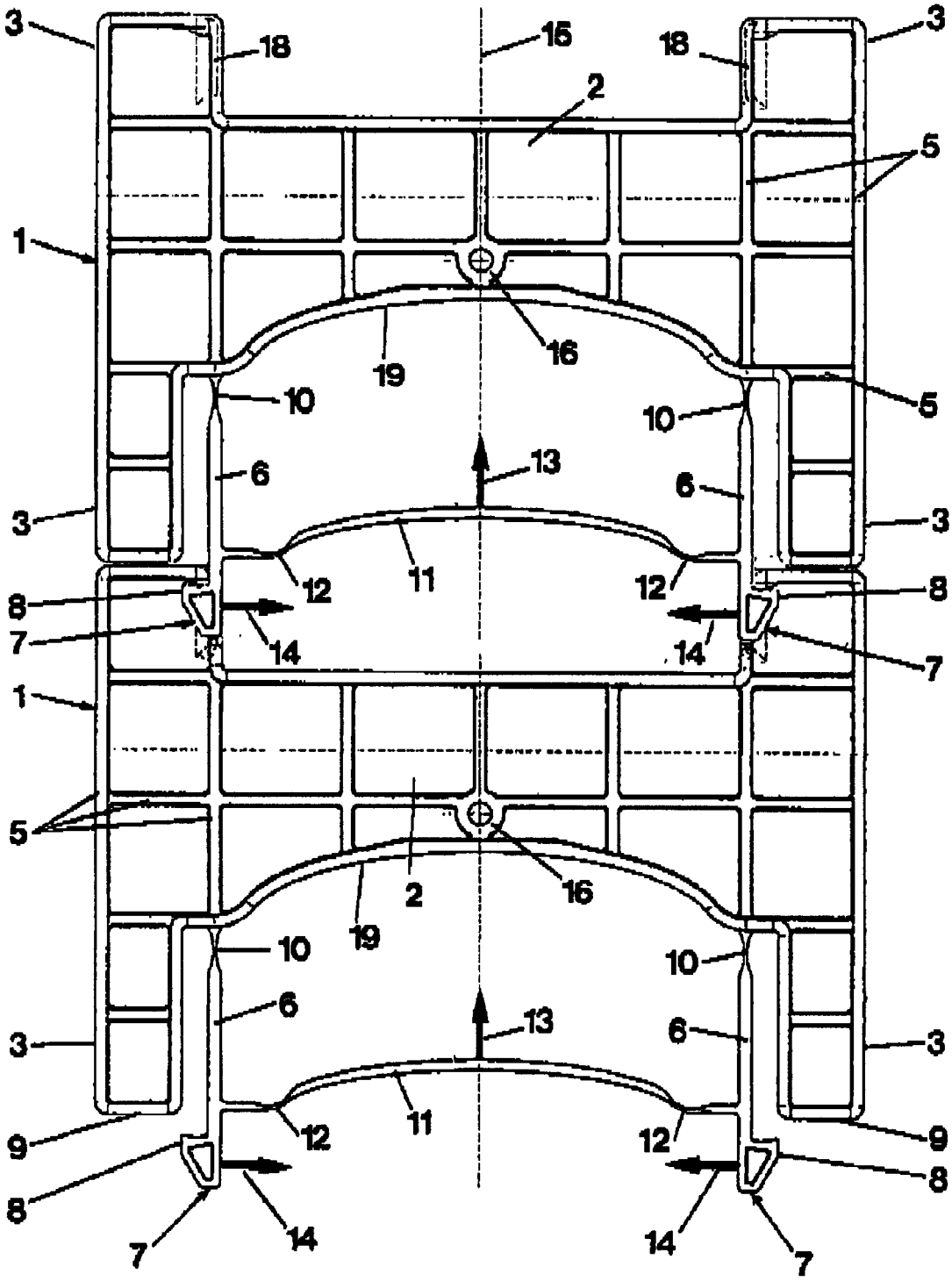
FIG. 5 shows two plate-shaped elements as presented in FIGS. 1 to 4 connected to one another.

The locking system for stacking boxes comprises individual plate-shaped elements 1, as are shown especially in FIGS. 1, 2 and 5 that show a first embodiment.

These plate-shaped elements 1 have, as can be seen in the side view of FIG. 2, an H-shape with a cross component 2 as well as four free ends 3. The plate-shaped elements 1 are manufactured as synthetic injection molding components. They exhibit an outer plate 4, as can be seen especially in FIGS. 3 and 4, where bracing fins 5 are stretching vertically from the plate. Horizontal and vertical bracing fins are provided, that are combined to a honeycomb-type structure. The upper free ends 3 of the plate-shaped element 1 are, in comparison, designed shorter than the lower free ends 3. Two locking components in the form of flexible arms 6, whose ends are designed as hook elements 7 with hook lips 8, are present between the lower free ends 3 of the plate-shaped element 1. These hook elements 7 protrude beyond the face side 9 of the lower free ends 3. The flexible arms 6 are attached to the cross component 2, where in the transition area towards the attachment point the bar-shaped flexible arm 6 is designed with a narrower section 10 to increase the flexibility and movability of these flexible arms 6. This pair of flexible arms 6, or the respective hook elements 7, is connected with a bar-shaped connecting component 11. The connecting component 11 is slightly curved towards the inside, that is, towards the cross component 2 of the plate-shaped element 1; in addition, comparable with the narrower regions 10 of the flexible arms 6, narrower flexible regions 12 are designed in the transition region between the connecting component 11 and the flexible arms 6. This connecting part 11 that runs about parallel to the cross component 2 serves the purpose of moving the hook elements 7 with the hook lips 8 by the flexible arms 6 being moved towards each other when the connecting part 11 is pulled with one hand in the direction of the arrow 13, such that the hook lips move in the direction of the arrows 14.

The plate-shaped elements 1 that are built symmetrically to the middle plane 15 shown in FIGS. 2 and 5 have in their center, that is in the center of cross component 2, an attachment bushing 16 with which they can be attached to the side wall of a respective stacking box 17 by guiding a screw through this attachment bushing 16 which is then screwed to the sidewall of the stacking box 17. Using two plate-shaped elements 2 attached to two opposing side walls, preferably the narrow sides of a stacking box 17 that is rectangular in top view, the respective stacking boxes 17 can be stacked on top of one another and at the same time can be locked using the locking elements in the form of hook elements 7 and their hook lips 8. To do this, locking components in the form of locking openings 18 are designed on the inner side of the upper free ends 3, where the openings are assigned to the corresponding hook lips 8.

FIG. 5 shows two plate-shaped elements 1 that are arranged on top of one another and that are assigned to an other lower and upper stacking box, stacked on the lower stacking box. As can be seen in FIG. 5, in the stacked condition of the respective stacking boxes, the hook lips 8 at the ends of the flexible arms 6 engage in the respective locking openings 18 of the plate-shaped element 1 of the stacking box stacked below, and grasp the edge of the opening such that they are securely locked to one another, particularly in the vertical direction. Respective stacks of stacking boxes that exhibit such plate-shaped elements 1 locked to one another are connected as one unit and can be transported in this manner. For a better grip on these stacking boxes, the cross component 2 is provided with a cavity or curvature at its lower sidewall 19 such that a respective grasping surface is created.

If the respective stacking boxes 17 (see FIG. 6) are to be taken from the stack, the connecting component 11 is grasped with the hand and pulled in the direction of the arrow 13 (see FIG. 5), such that a force is exerted on the hook elements 7 in the direction of the two arrows 14 and the hook lips 8 are disengaged from the engagement with the locking openings 18. The respective stacking box 17 can then be removed. When such a stacking box 17 is removed, the connecting component 11 is released such that the flexible arms 6 with the hook elements 7 return to a position as shown, for example, in FIG. 2 or in FIG. 5.

As is illustrated in FIG. 5 and the description above, no special handling procedure is required for releasing the respective stacking boxes, because the actuation component 11 becomes accessible and can be actuated when grasping the stacking box 17 for removal from the stack.

Figure 6:
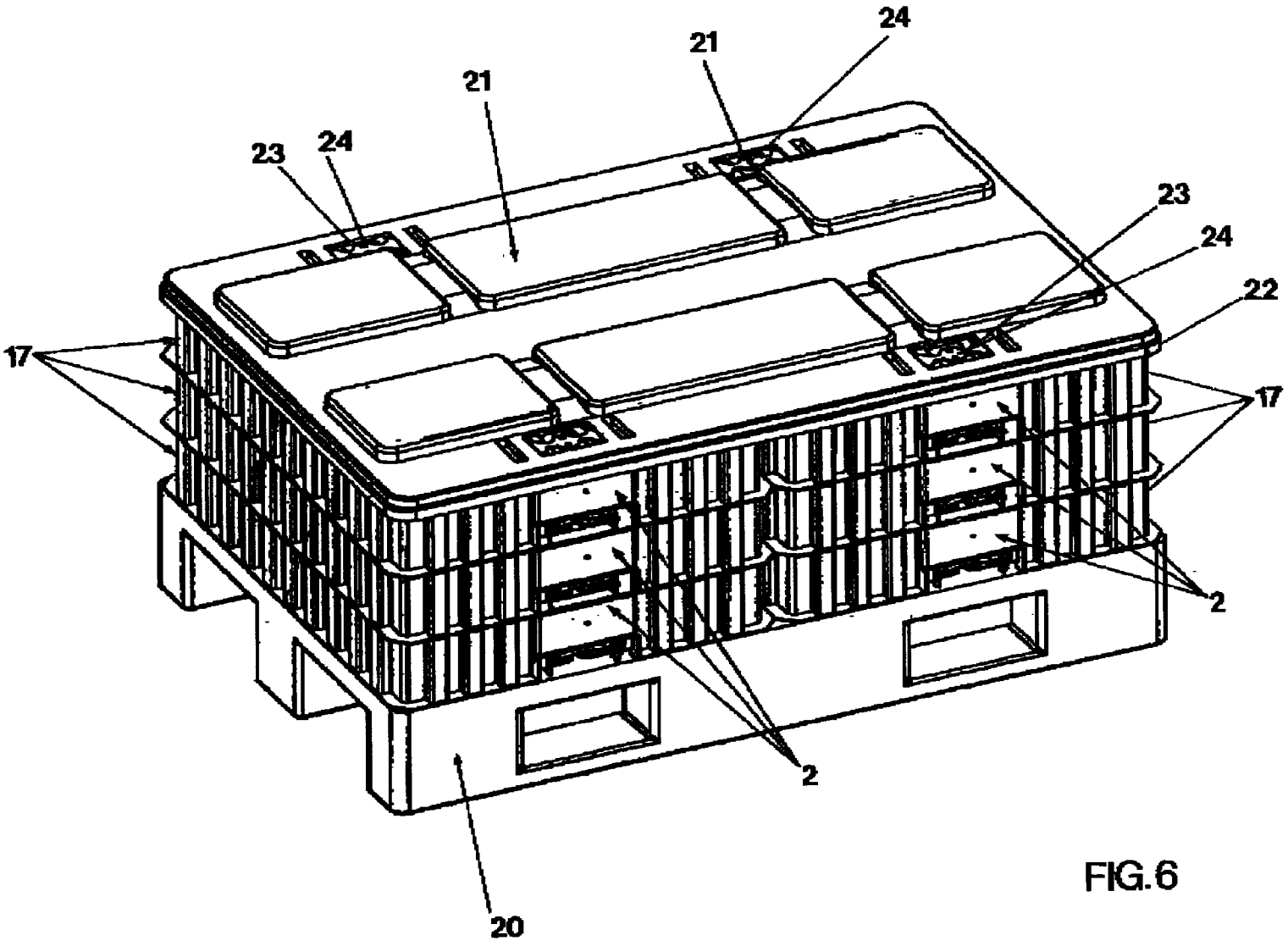
FIG. 6 shows a perspective view of two stacks of stacking boxes arranged on, a palette, where the stacking boxes are covered with common covering.

As FIG. 6 shows, several stacking boxes 17, fitted in their format to the palette 20, can be placed on the palette, which can be a Euro palette or any other special palette, where in FIG. 6 the rectangular base format of the palette 20 is occupied by two stacking boxes each corresponding to the entire width and half the length of this palette 20 to form the bottom stacking box layer. Each of these stacks of stacking boxes 17 consists of three stacking boxes 17. These three stacking boxes 17 of a stack are locked to one another with the plate-shaped elements 1, as is shown in FIG. 5. As can be seen in FIG. 6 as well, the plate-shaped elements 1 are integrated in corresponding cavities on the narrow side of the stacking boxes 17 such that they do not protrude beyond the outside of the stacking boxes 17.

While the individual stacks of stacking boxes 17 are locked to one another with the plate-shaped elements 1, the respective bottom stacking box 17 of a stack is locked to the palette 20 by the hook elements 7, as can be seen in FIG. 5, engaging in the corresponding openings in the base of the palette 20, not shown in FIG. 6, and locking the connection. To release the respective bottom stacking box 17 from being locked to the palette 20 when removing the individual stacking boxes 17, the locking component 11 is also used to release the hook elements 7 from their engagement as was described above using FIG. 7.

FIG. 6 shows, furthermore, that the two upper stacking boxes 17 of the two stacks are covered with a plate-shaped covering 21 that also exhibits a small edge 22 that grasps the outer edges of the top stacking boxes 17. This plate-shaped covering 21 has four openings, designated in FIG. 6 with the designation 23, where movable latches are inserted at about the level of the plate-shaped covering 21. These movable latches, where two of these latches can be provided in each of these openings 23, have the purpose to move into the locking openings 18 at the upper, free ends 3 of the plate-shaped element 1 (see particularly FIG. 5) such that the plate-shaped covering 21 is securely connected to the plate-shaped elements 1 of the top stacking boxes 17.

As can be seen from the description of the exemplary embodiment and as the presentation in FIG. 6 clearly shows, the locking system subject to the invention clearly provides the possibility to arrange numerous stacking boxes that are stacked in individual stacks on a palette and in this manner prepare them for shipping such that no separate packaging material such as strapping bands or shrink film are required. These pallets can be provided to the customer, where the components stored in the stacking boxes 17 can be retrieved by removing the plate-shaped covering 21.

It is understood that certain modifications and variations may be made. For example, at the bottom of a plate-shaped element, only one hook lip 8 may be provided, that engages in a corresponding opening at the top side of a plate element located below or above. These hook-shaped elements may also be provided at the top side of the plate-shaped element 1, while the locking openings at the bottom side must then be designed. However, it is also apparent that the presented embodiment is preferred because it provides certain advantages as are noted.

Figure 7:
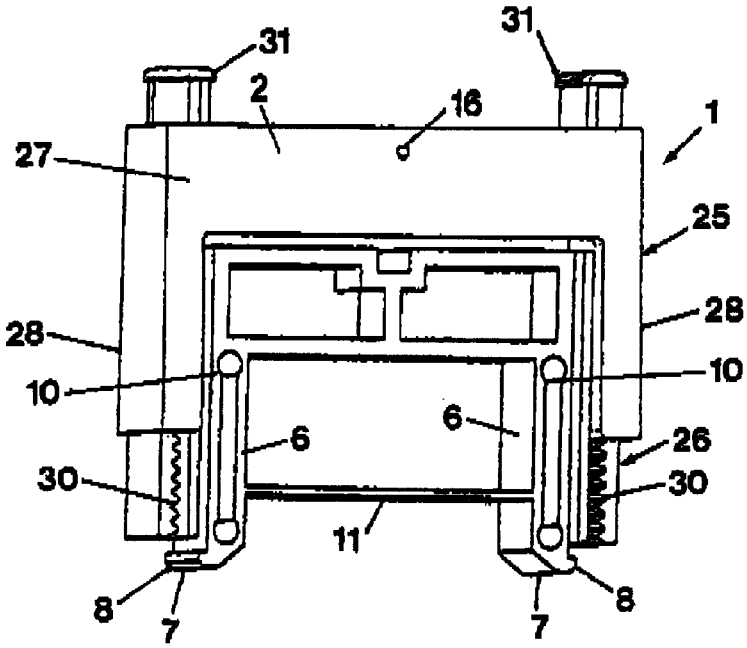
FIG. 7 shows a perspective view of a plate-shaped element of a second embodiment that is constructed of two element components that can be adjusted in their assignment to one another, viewed from the rear.
Figure 8:
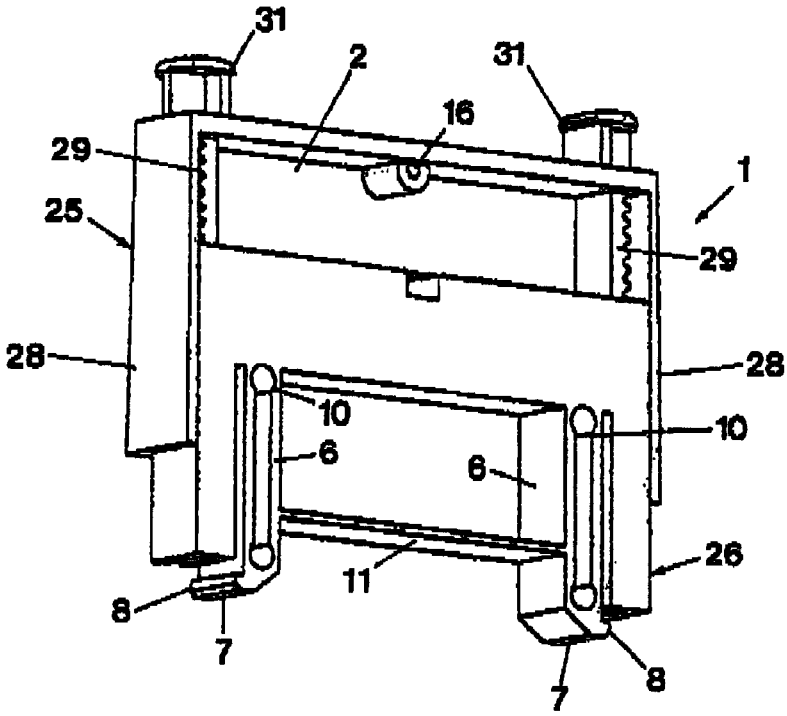
FIG. 8 shows a perspective view of the element of FIG. 7 viewed from the front.
Figure 9:
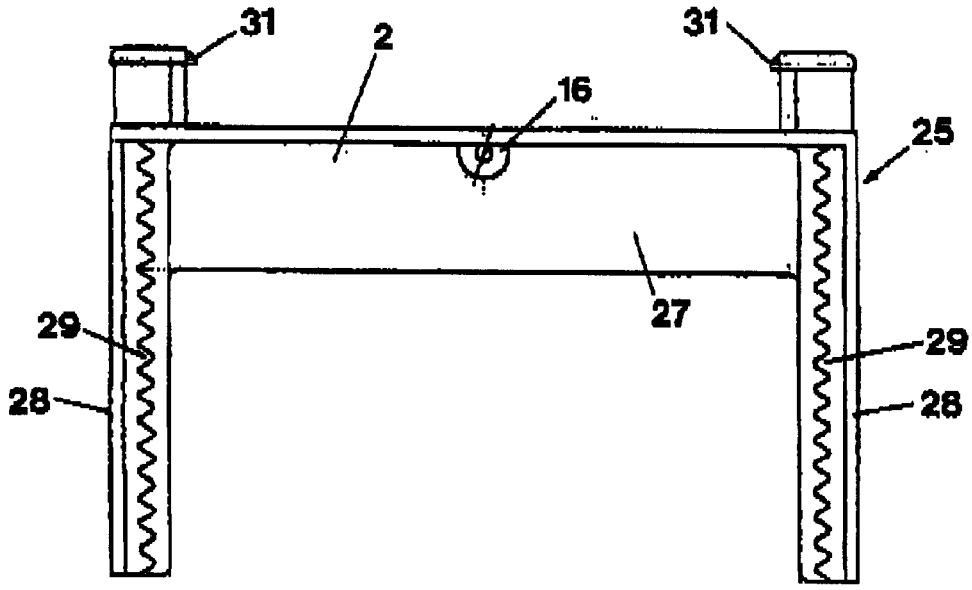
FIG. 9 shows an over head view of the one upper element component of the second embodiment as presented in FIGS. 7 and 8.

A modified design of a plate-shaped element according to a second embodiment is shown in FIGS. 7 to 9.

Where the second embodiment exhibits elements and components that correspond to those of the first embodiment, as presented in FIGS. 1 through 6, or correspond to the respective components of the first embodiment in their function and purpose, the same designations are used for both embodiments. A description of such components with regard to the second embodiment is then not provided again.

Figure 10:
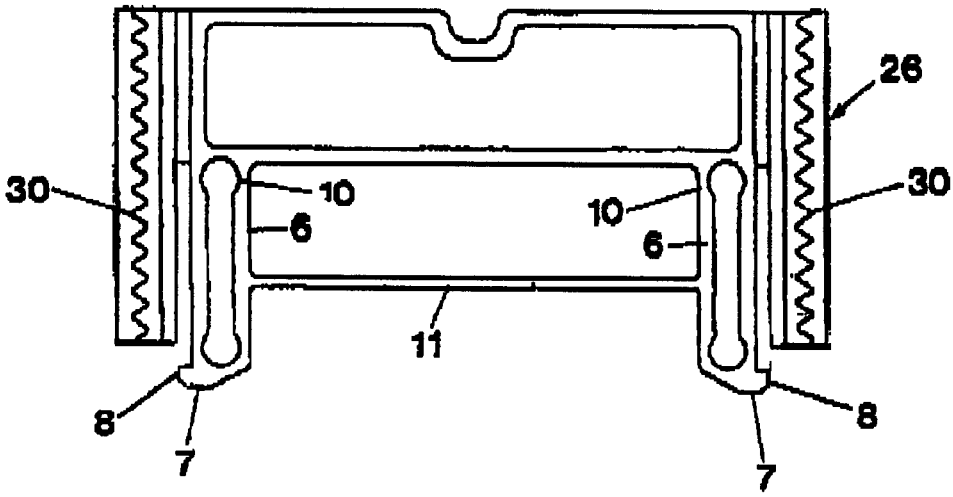
FIG. 10 shows an over head view of the bottom element component of the second embodiment.

The plate-shaped element 1 of the second embodiment is comprised of a first element component 25, shown in an over head view in FIG. 9, and a second element component 26, shown in an over head view in FIG. 10. The first element component 25 has a U-shaped structure with a cross beam 27 and two legs 28; furthermore, toothed racks or toothings 29 designed in the form of toothed racks are designed along the legs 28, that is, on the inside of each of the legs 28.

The second element component 26, which is shown in FIG. 10, corresponds in its structure to the bottom area of the plate-shaped element 1 of FIG. 1 with the respective hook elements 7 as well as the connecting components 11 for moving the two hook elements. A toothing 30 designed as a toothed rack with toothing elements pointing to the outside is provided on the outside of this second element component 26 as well. The toothings 29 of the first element component 25 and the toothings 29 of the second element component 26 are dimensioned and positioned such that they can be engaged in one another, as is shown in FIGS. 7 and 8 from the back side and the front side respectively. For this purpose, the second element component 26 of FIG. 10 is turned from the position shown in FIG. 10 and from above, that is, perpendicular to the drawing plane, inserted into the toothing 29 of the first element component 25 of FIG. 9. Due to a different positioning of the respective toothings 29, 30 towards each other, the distance of the hook elements 7 to the corresponding counter pieces on the first element component 25, which are hooks as well, designated with the reference number 31, can be varied contrary to the locking openings 18 of the first embodiment.

Corresponding to the first embodiment, an attachment bushing 16 is provided for the second embodiment as well, where said bushing can be used to attach the first element component 25 to the outside of a stacking box, in a position as shown in FIG. 7. In this position, the first element component 25 holds the second element component 26 positioned below, such that no additional attachment elements are required to secure the two element components 25, 26. If required, additional attachment bushings 16 can be provided at respective positions, for example, in the area of the two legs 28 of the first element component 25.

In its additional functionality, the second embodiment, as presented in FIGS. 7 through 10, corresponds to that of the first embodiment that is shown in FIGS. 1 through 6.

There has thus been shown and described a novel locking system for stacking boxes as well as a stacking box system which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A locking system for stacking boxes, comprising two individual plate-shaped elements wherein each are assigned and can be attached to two opposite sides of a stacking box, wherein each element exhibits locking components at its top and bottom side, that can be locked in an engaging manner to locking components of elements that are assigned to a stacking box stacked above or below; wherein the locking components include hook elements; wherein the hook elements are assigned to the lower side of the element; and wherein the respective hook elements of a pair are connected by a connecting component that releases the two hook elements simultaneously from their engagement by exerting a pull force.

2. Locking system as set forth in claim 1, whereby the connecting component releases releasing the hook elements from their engagement with the locking components of the other element.

3. Locking system as set forth in claim 1, wherein the hook elements exhibit flexible arms.

4. Locking system as set forth in claim 1, wherein each hook element exhibits a hook lip.

5. Locking system as set forth in claim 1, wherein the hook lips of a hook element pair point away from each other towards the outside of element.

6. Locking system as set forth in claim 1, wherein the plate-shaped element exhibits an H-shape with a cross bar and four free ends.

7. Locking system as set forth in claim 6, wherein locking components in the form of openings for engaging the hook elements are designed at two of the four free ends of the H-shaped element.

8. Locking system as set forth in claim 6, wherein the flexible arms of the hook elements engage at the cross bar.

9. Locking system as set forth in claim 3, wherein the connecting component is arranged in the area of the free ends of the flexible arms.

10. Locking system as set forth in claim 6, wherein the connecting component extends substantially parallel to the cross bar.

11. Locking system as set forth in claim 10, wherein the connecting component is curved in a bow shape towards the cross bar.

12. Locking system as set forth in claim 1, wherein the plate-shaped element is constructed of flat elements with bracing fins.

13. Locking system as set forth in claim 1, wherein the plate-shaped element is a synthetic injection mold component.

14. Locking system as set forth in claim 1, wherein the plate-shaped element is assigned to a cavity in a sidewall of a stacking box.

15. Stacking box system with several stacking boxes stacked on top of one another, where each stacking box exhibits a locking system as set forth in claim 1, wherein the individual stacking boxes can be locked to one another.

16. Stacking box system as set forth in claim 15, wherein the respective bottom stacking box is locked to a palette using its locking system.

17. Stacking box system as set forth in claim 16, wherein the respective top stacking box is covered with a covering, this covering being locked to at least one part of the locking elements of the top most stacking box.

18. Stacking box system as set forth in claim 17, wherein the covering exhibits movable latches that engage in the locking elements.

19. Stacking box system as set forth in claim 18, wherein several stacks made up of the same number of stacking boxes are arranged next to one another, the top most stacking boxes being covered by a common covering and being secured against each other by the covering.

* * * * *